US006474835B1

(12) United States Patent
Lin

(10) Patent No.: US 6,474,835 B1
(45) Date of Patent: Nov. 5, 2002

(54) TOUCH-CONTROLLED LIGHTING CIRCUIT ASSEMBLY

(76) Inventor: Mon-Sheng Lin, 5th Fl., No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 09/846,289

(22) Filed: May 2, 2001

(51) Int. Cl.[7] ..... F21L 4/04
(52) U.S. Cl. ..... 362/206; 362/363
(58) Field of Search ..... 362/206, 363, 362/196, 253; 439/823, 824

(56) References Cited

U.S. PATENT DOCUMENTS 4,445,164 A * 4/1984 Giles et al. ..... 362/311
4,471,414 A * 9/1984 Savage ..... 362/226
6,155,700 A * 12/2000 Hsu ..... 362/363

* cited by examiner

*Primary Examiner*—Sandra O'Shea
*Assistant Examiner*—John Amarantides
(74) *Attorney, Agent, or Firm*—Troxell Law Office PLLC

(57) ABSTRACT

A touch-controlled lighting circuit assembly includes a holder shell having a top open chamber, a bottom open chamber and a through hole between the top open chamber and the bottom open chamber, a battery set installed in the bottom open chamber, and a light-emitting element installed in the top open chamber with a first lead-out wire inserted through the through hole of the holder shell and maintained in contact with the negative terminal of the battery set and a second lead-out wire extended out of the holder shell and suspended below the bottom open chamber and adapted to touch the positive terminal of the battery set for causing the light-emitting element to emit light when vertically pressed against the bottom open chamber of the holder shell.

3 Claims, 7 Drawing Sheets

TOUCH-CONTROLLED LIGHTING CIRCUIT ASSEMBLY

BACKGROUND OF THE INVENTION

The present invention relates to a lighting circuit assembly and, more particularly, to a touch-controlled lighting circuit assembly, which has a compact and simple structure and, is easy to assemble.

Regular touch-controlled lighting circuit assemblies include two types, one with the battery set disposed in horizontal and the other with the battery set disposed in vertical. Holding the battery set in horizontal requires much installation space. FIGS. 1 and 2 show two different touch-controlled lighting circuit assemblies according to the prior art. According to the design of FIG. 1, the light-emitting element has a first lead-out wire maintained in contact with the negative terminal of the battery set, and a second lead-out wire connected to a metal spring member with a metal contact plate outside the holder shell, which holds the battery set, the light-emitting element and the metal spring member. This structure of touch-controlled lighting circuit assembly requires much installation space. When used in a pen, the touch-controlled lighting circuit assembly affects the writing convenience of the pen and, destroys the sense of beauty of the outer appearance of the pen. According to the design of FIG. 2, the spring is disposed at the bottom side of the battery set. This design requires much longitudinal installation space. When installed in a bubble blower toy, the touch-controlled lighting circuit assembly occupies much inside space of the bubble blower toy, and available bubble solution holder space will be greatly reduced.

SUMMARY OF THE INVENTION

The present invention has been accomplished to provide a touch-controlled lighting circuit assembly, which eliminates the drawbacks of the aforesaid prior art designs. It is one object of the present invention to provide a touch-controlled lighting circuit assembly, which has a compact structure for easy installation. It is another object of the present invention to provide a touch-controlled lighting circuit assembly, which requires less installation space. It is still another object of the present invention to provide a touch-controlled lighting circuit assembly, which is inexpensive to manufacture. According to the present invention, the touch-controlled lighting circuit assembly comprises a holder shell having a top open chamber, a bottom open chamber and a through hole between the top open chamber and the bottom open chamber, a battery set installed in the bottom open chamber, and a light-emitting element installed in the top open chamber with a first lead-out wire inserted through the through hole of the holder shell and maintained in contact with the negative terminal of the battery set and a second lead-out wire extended out of the holder shell and suspended below the bottom open chamber and adapted to touch the positive terminal of the battery set for causing the light-emitting element to emit light when vertically pressed against the bottom open chamber of the holder shell. Because the holder shell, the light-emitting element and the battery set are set together, the touch-controlled lighting circuit assembly can be directly installed in the penholder or press-head of a writing apparatus. Because the touch-controlled lighting circuit assembly has a small outer diameter and height, it can be used in a pen of small diameter. Because the touch-controlled lighting circuit assembly eliminates the use of metal spring member and contact plate, the manufacturing cost of the touch-controlled lighting circuit assembly is low.

DETAILED DESCRIPTION OF THE PREFERRED EMBODIMENT

Figure 1:
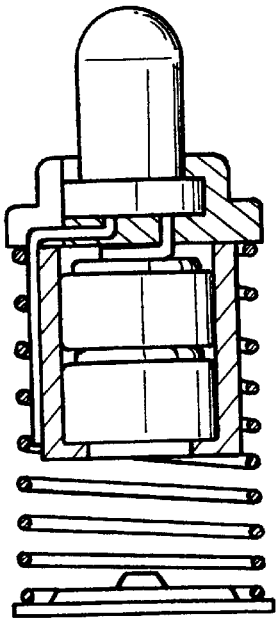
Prior Art FIG. 1
FIG. 1 illustrates a touch-controlled lighting circuit assembly according to the prior art.
Figure 2:
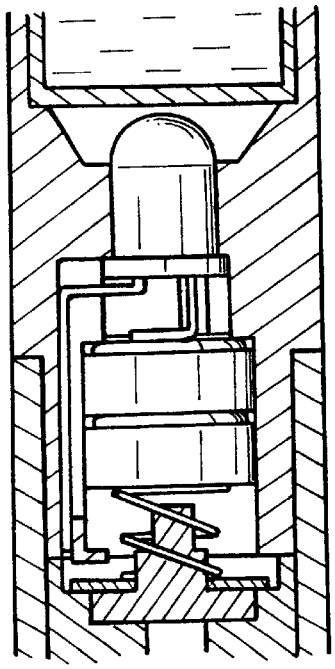
Prior Art FIG. 2
FIG. 2 illustrates another structure of touch-controlled lighting circuit assembly according to the prior art.
Figure 3:
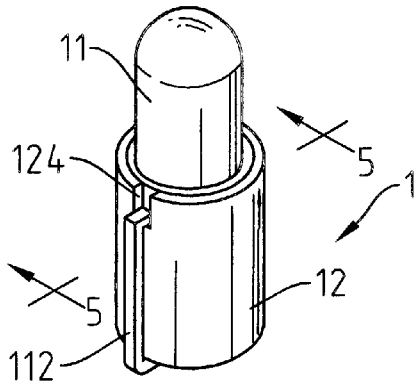
FIG. 3 is an elevational view of a touch-controlled lighting circuit assembly according to the present invention.
Figure 4:
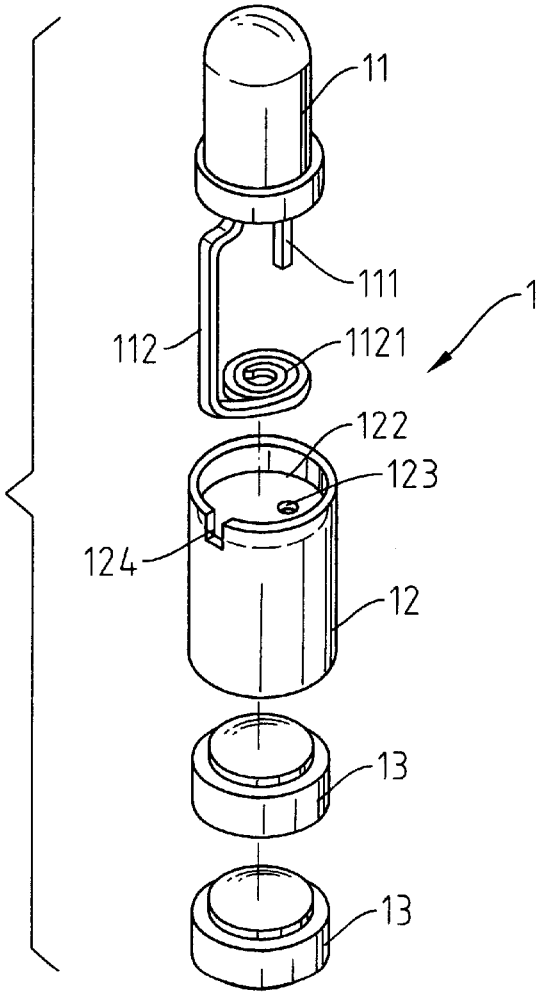
FIG. 4 is an exploded view of the touch-controlled lighting circuit assembly according to the present invention.
Figure 5:
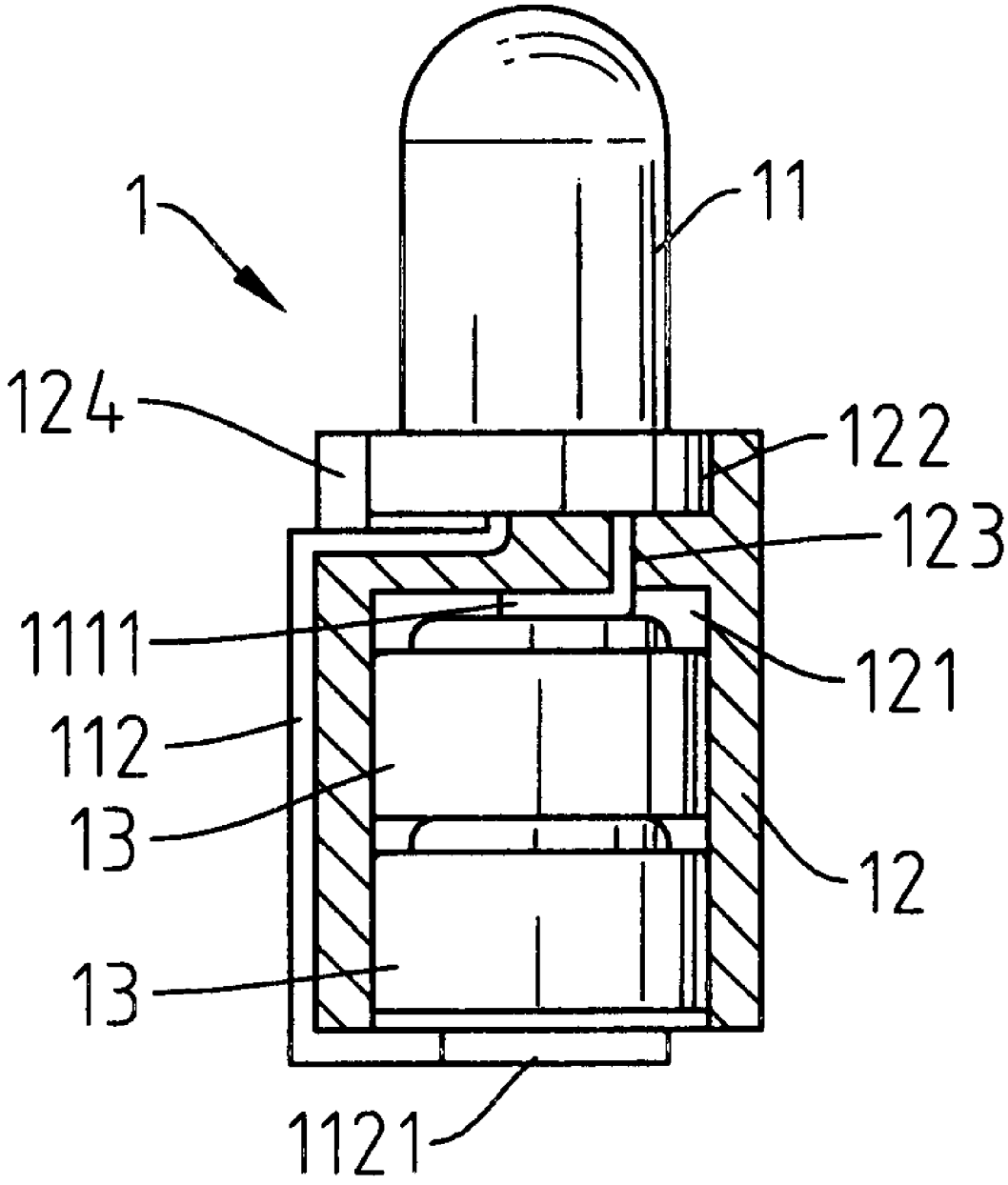
FIG. 5 is a longitudinal view in section of the touch-controlled lighting circuit assembly according to the present invention.

Referring to FIGS. from 3 through 5, a touch-controlled lighting circuit assembly 1 is shown comprised of a light-emitting element 11, a holder shell 12, and a battery set comprised of at least one, for example, two battery cells 13. The holder shell 12 comprises a bottom open chamber 121, a top open chamber 122 separated from the lower chamber 121, a through hole 123 through the partition wall between the bottom open chamber 121 and the top open chamber 122, and a top peripheral notch 124 at one side of the periphery of the top open chamber 122. The battery set 13 is installed in the bottom open chamber 121. The light-emitting element 11 is mounted in the top open chamber 122, having a first lead-out wire 111 inserted through the through hole 123 into the bottom open chamber 121 and a second lead-out wire extended out of the top peripheral notch 124 to the outside of the holder shell 1. After inserted through the through hole 123, the first lead-out wire 111 is bent at right angles and disposed in contact with the negative pole of the battery set 13. The second lead-out wire 112 has a tail end terminating in a spiral contact portion 1121 suspending below the bottom open chamber 121 of the holder shell 12 and spaced from the positive terminal of the battery set 13 at a distance. When giving a pressure to the spiral contact portion 1121 against the holder shell 12, the spiral contact portion 1121 is forced into contact with the positive terminal of the battery set 13 to close the circuit of the battery set 13 and the light-emitting element 11, and therefore the light-emitting element 11 is electrically connected to emit light.

Figure 6:
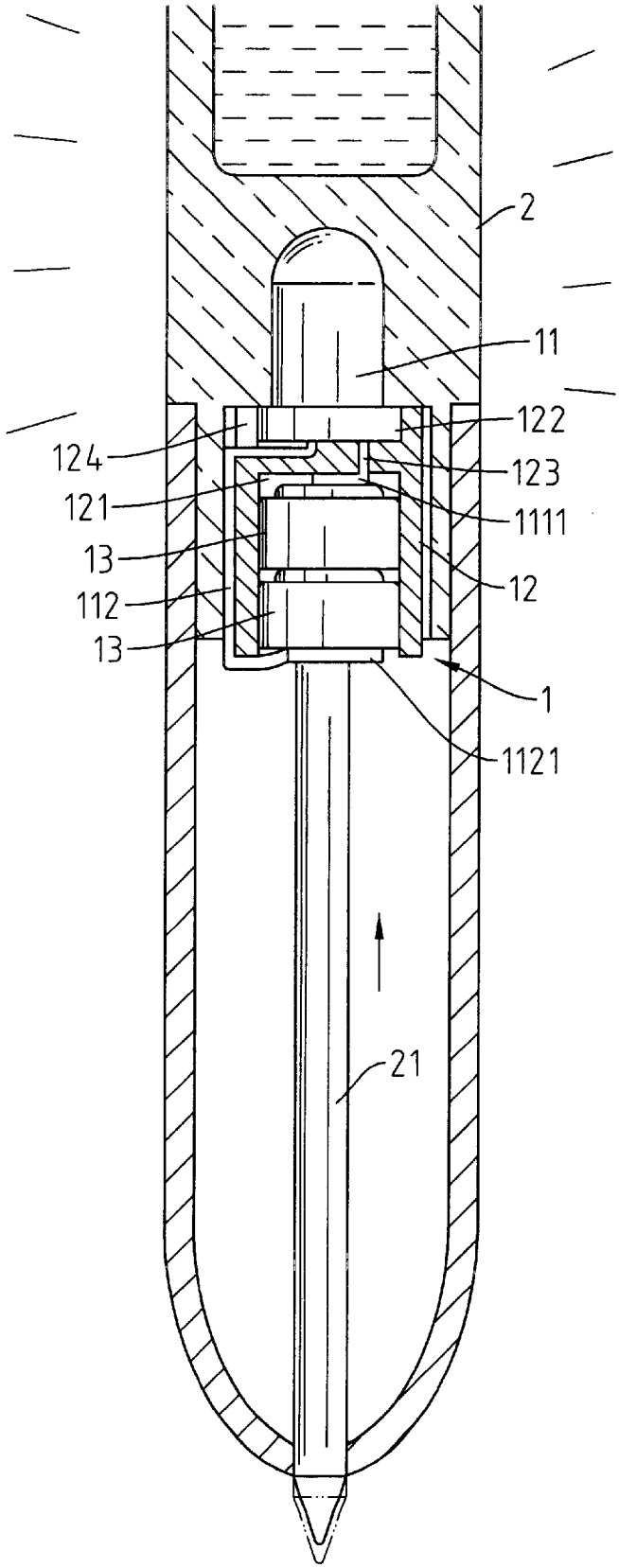
FIG. 6 shows an application example of the touch-controlled lighting circuit assembly according to the present invention.
Figure 7:
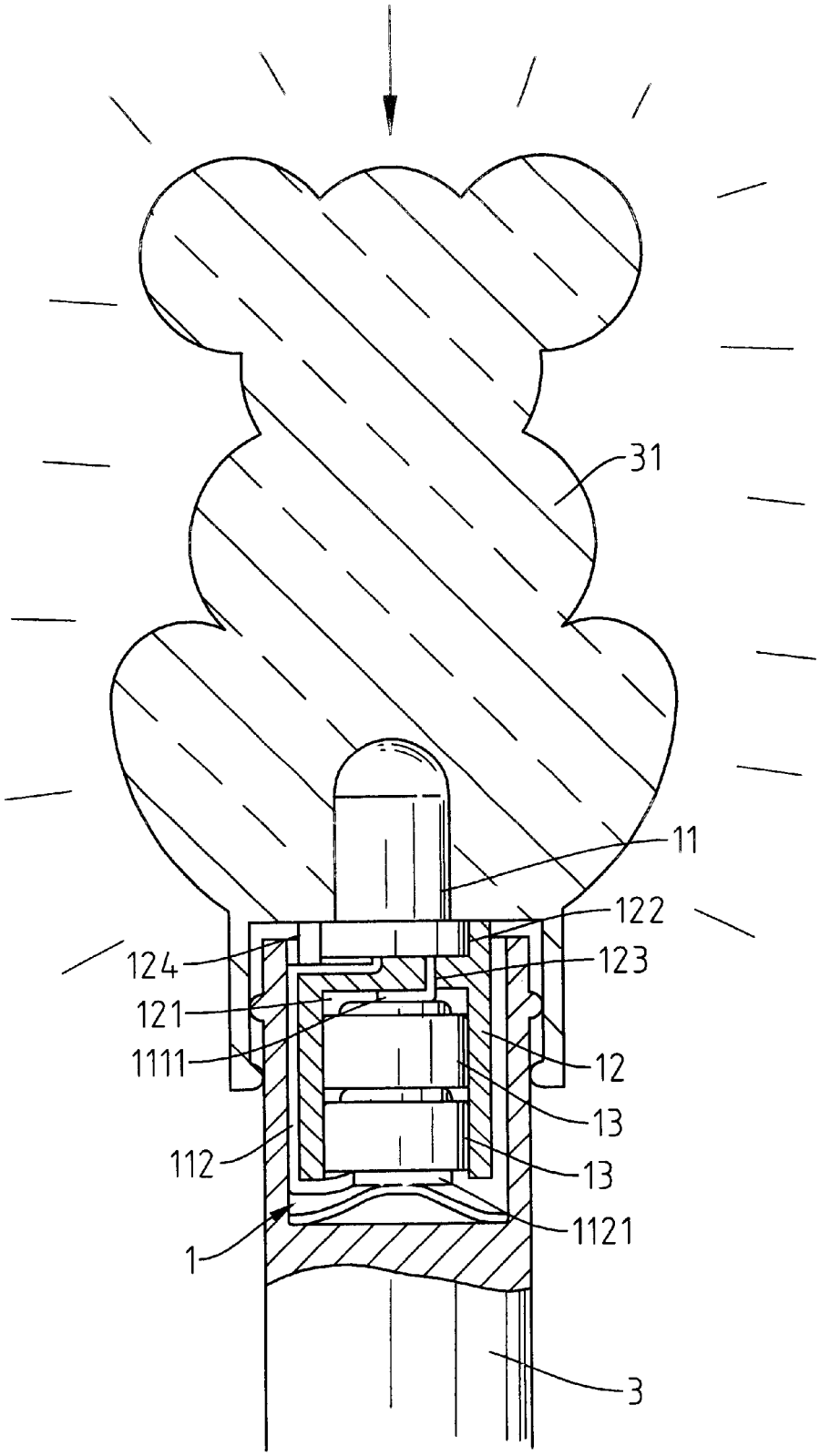
FIG. 7 shows another application example of the touch-controlled lighting circuit assembly according to the present invention.
Figure 8:
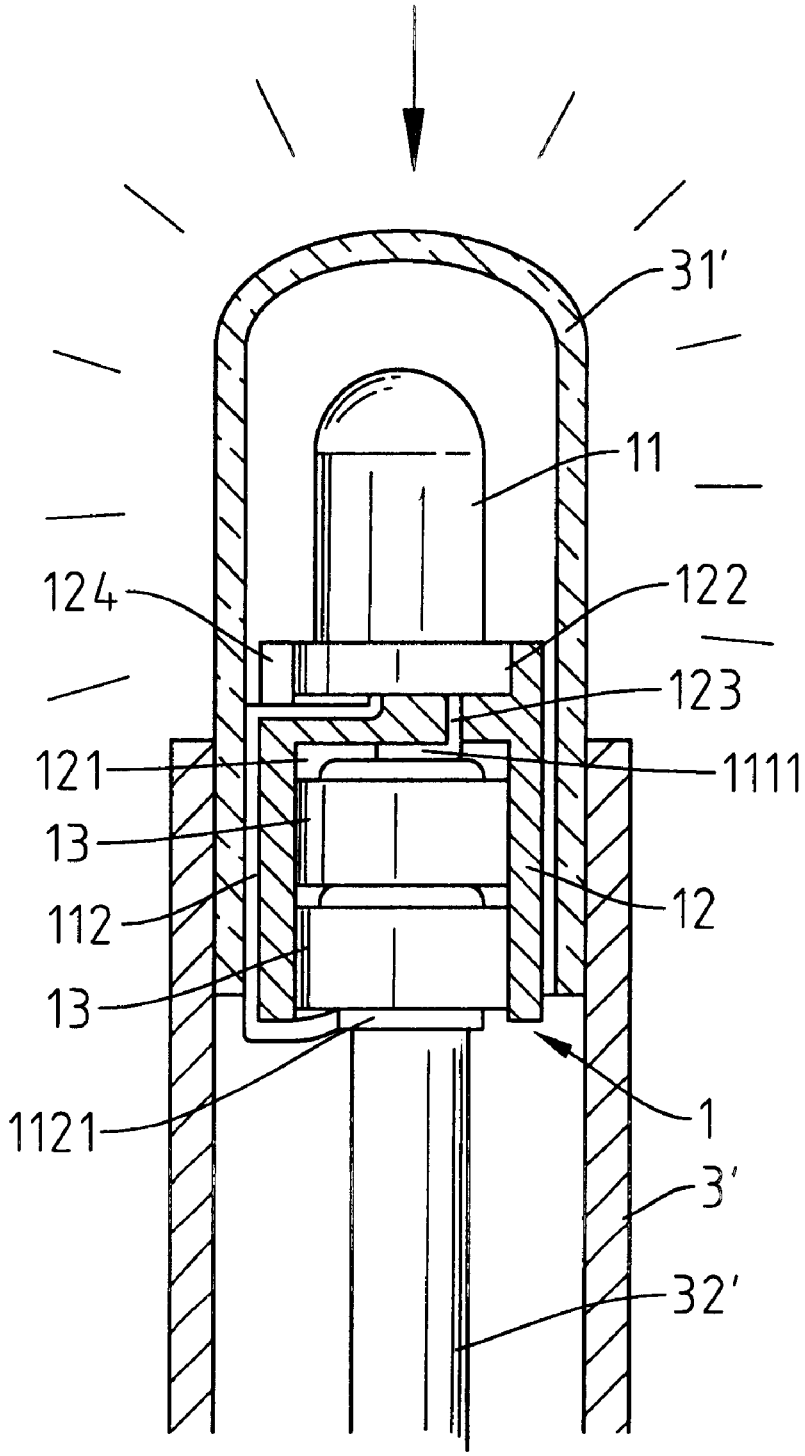
FIG. 8 shows still another application example of the touch-controlled lighting circuit assembly according to the present invention.
Figure 9:
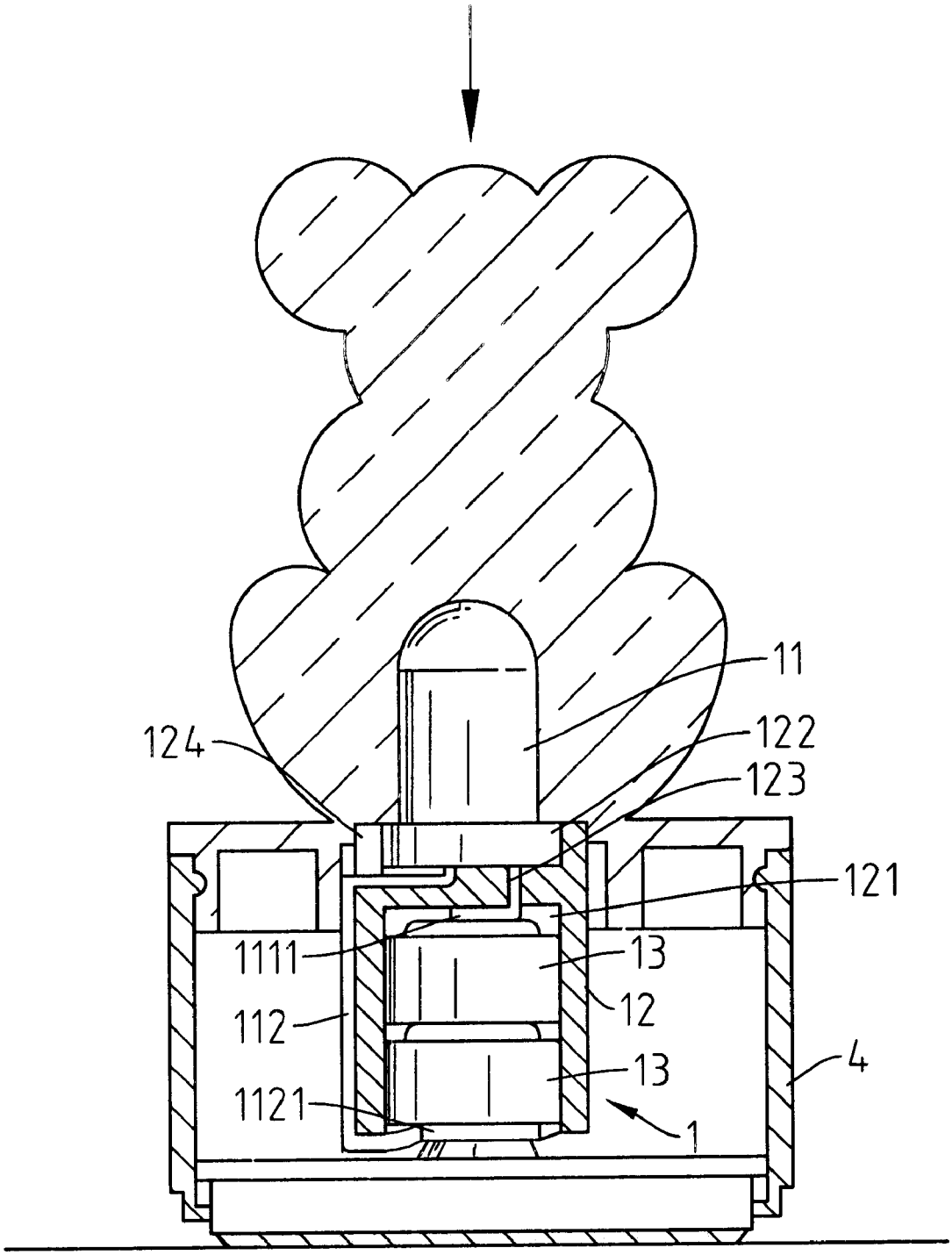
FIG. 9 shows still another application example of the touch-controlled lighting circuit assembly according to the present invention.

Referring to FIGS. from 6 through 9, the touch-controlled lighting circuit assembly 1 can be used in any of a variety of apparatus. In FIG. 6, the touch-controlled lighting circuit assembly is used in a bubble-blower pen 2 with the spiral contact portion 1121 of the second lead-out wire 112 of the light-emitting element 11 stopped at the topside of the writing element 21 of the bubble-blower pen 2. When writing, the spiral contact portion 1121 is forced upwards by the writing element 21 to touch the positive terminal of the battery set 13, and the light-emitting element 11 is electrically turned on to emit light. FIGS. 7 and 8 show the touch-controlled lighting circuit assembly used in different writing apparatus, in which the contact portion 1121 of the second lead-out wire 112 of the light-emitting element 11 touches the writing element 32' to close the circuit of the battery set 13 and the light-emitting element 11 when the user pressing the press-head 31;31' of the writing apparatus 3;3', thereby causing the light-emitting element 11 to emit light. In FIG. 9, the touch-controlled lighting circuit assembly 1 is used in a stamp 4, and the light-emitting element 11 is electrically connected to emit light when stamping the stamp 4 on a sheet member.

A prototype of touch-controlled lighting circuit assembly constructed with the features of FIGS. 3~9. The touch-controlled lighting circuit assembly functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A touch controlled lighting assembly comprising:

a) a holder shell having a bottom chamber with an open bottom and a top chamber separated by a partition wall;

b) at least one battery mounted in the bottom chamber, the at least one battery having a first terminal adjacent to the partition and a second terminal adjacent to the open bottom of the bottom chamber; and, c) a light emitting element mounted in the top chamber and having a first lead out wire passing through the partition and contacting the first terminal and a second lead out wire extending outwardly of the holder shell, along an outer surface of the holder shell and ending in a tail end having a spiral contact portion located adjacent to the open bottom and spaced from the second terminal, whereby bending of the spiral contact portion brings the spiral contact portion into contact with the second battery terminal to light the light emitting element.

2. The touch controlled lighting assembly of claim 1 further comprising two batteries mounted in the bottom chamber.

3. The touch controlled lighting assembly of claim 1 further comprising a notch in the holder shell communicating with the top chamber through which the second lead out wire passes.

* * * * *